US005428883A

United States Patent [19]

Stieglitz

[11] Patent Number: 5,428,883

[45] Date of Patent: Jul. 4, 1995

[54] PROCESS FOR MANUFACTURING A MAGNETIC CIRCUIT FOR A VALVE

[75] Inventor: Peter Stieglitz, Bamberg, Germany

[73] Assignee: Robert Bosch GmbH, Stuttgart, Germany

[21] Appl. No.: 210,967

[22] Filed: Mar. 21, 1994

[30] Foreign Application Priority Data

Apr. 1, 1993 [DE] Germany ..... 43 10 719.2

[51] Int. Cl.[6] ..... H01F 41/02

[52] U.S. Cl. ..... 29/602.1; 29/423; 251/129.15; 239/585.1

[58] Field of Search ..... 29/602.1, 606, 423; 251/129.15, 129.21; 239/585.1

[56] References Cited

U.S. PATENT DOCUMENTS 5,069,834 12/1991 Babitzka ..... 29/602.1 X
5,185,919 2/1993 Hickey ..... 29/602.1
5,222,673 6/1993 Reiter ..... 239/585.1

FOREIGN PATENT DOCUMENTS

4013832A1 10/1991 Germany .

*Primary Examiner*—Carl E. Hall
*Attorney, Agent, or Firm*—Kenyon & Kenyon

[57] ABSTRACT

A process for manufacturing an electromagnetically actuated fuel-injection valve with a connecting ring of a non-magnetic material hermetically and permanently installed between an internal pole and a valve sleeve designed separately from the internal pole. The process reduces the cost of manufacturing fuel-injection valves by avoiding costly operations involved in the fabrication and assembly of the highly precise individual structural elements and in producing the hermetic and permanent connections. A one-piece magnet body is formed with an internal pole and an outer valve sleeve joined by a base. Above the base, the internal pole and the valve sleeve are radially separated by an axially running ring opening. A solder member and a non-magnetic intermediate ring are inserted into the ring opening, and the intermediate ring is then soldered to the magnet body. The base is then removed, thereby separating the internal pole and the valve sleeve.

9 Claims, 4 Drawing Sheets

PROCESS FOR MANUFACTURING A MAGNETIC CIRCUIT FOR A VALVE

FIELD OF THE INVENTION

The present invention pertains to a process for manufacturing a valve. More specifically, the present invention pertains to a process for manufacturing a magnetic circuit for a fuel-injection valve used in an internal combustion engine.

BACKGROUND OF THE INVENTION

A fuel-injection valve with electromagnetic actuation is described in published German Patent Application No. 40 13 832 A1. In the fuel-injection valve described therein, a connecting ring, formed from a non-magnetic material having a high specific electrical resistance, is securely and hermetically joined to an internal pole and to a valve sleeve of the fuel-injection valve. This ensures that no fuel can reach a solenoid situated between the internal pole and the valve sleeve; i.e., a solenoid surrounding the internal pole and being surrounded itself by the valve sleeve. Because the connecting ring is made of a non-magnetic material, its effect on the magnetic field is quite negligible. The connecting ring prevents a magnetic short-circuit between the internal pole and the valve sleeve and avoids additional eddy losses.

The fitting of the connecting ring, however, is a relatively cost-intensive process. For example, to manufacture the magnet body out of an internal pole, a valve sleeve and a connecting ring, an inner and outer soldering ring are still needed to be able to produce permanent, hermetically sealed connections. Thus, for example, five individual component parts are needed to manufacture the magnet body. The individual structural elements, i.e., the internal pole, valve sleeve, and connecting ring, must be manufactured very precisely and assembled together before the jointing operation. Manufacturing the individual, highly precise structural elements, and assembling the structural elements, while achieving hermetic and secure connections, entail expensive processes.

SUMMARY OF THE INVENTION

The present invention provides a process for manufacturing a magnetic circuit for a valve, in particular for a fuel-injection valve, that allows a magnet body to be manufactured inexpensively using few individual structural elements. The present invention uses a one-piece, extruded magnet body, thereby avoiding the need for highly precise individual component parts. The design of the magnet body is such that an inner internal pole and an outer valve sleeve are connected by a base, while above the base, the internal pole and the valve sleeve lie radially separated by a circumferential ring opening running in the axial direction.

Once the magnet body as described above is formed, a soldering disk made of a hard solder and a non-magnetic, annular intermediate ring are inserted into the ring opening and placed on the bottom of the opening. By inserting the soldering disk and the intermediate ring into the ring opening of the magnet body in this manner, the manufacturing process is clearly simplified and made less expensive. The step of fixing the internal pole and the valve sleeve in position with respect to the intermediate ring to avoid any tilting or slipping out of a defined position is completely eliminated. After the simple and inexpensive step of inserting the soldering disk and the intermediate ring into the ring opening, the soldering operation can take place without making any further adjustments or stops. The internal pole and the valve sleeve are finally separated by removing the base, for example by grinding it off. This step is relatively simple and inexpensive.

DETAILED DESCRIPTION OF THE DRAWINGS

Figure 1:
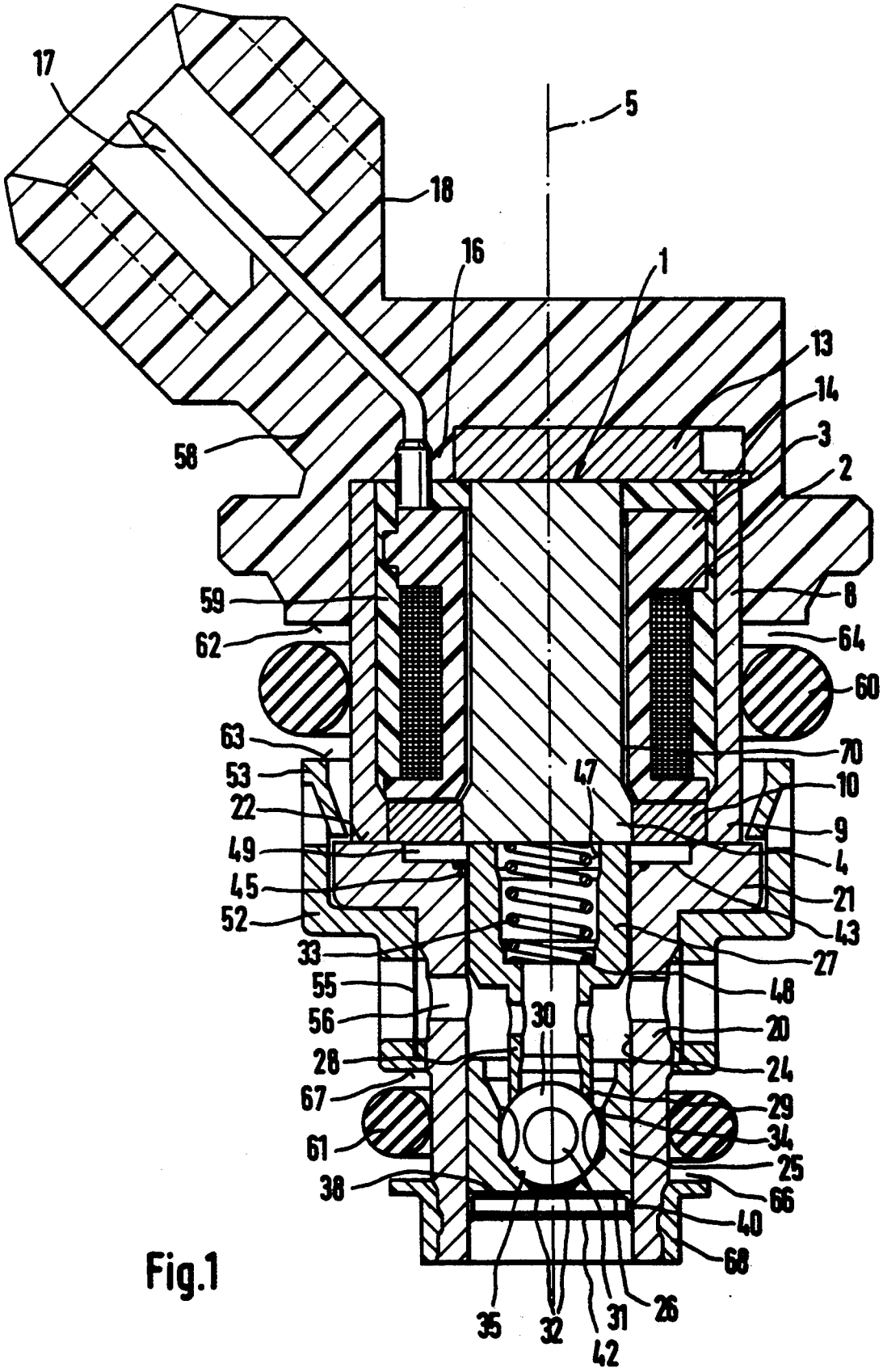
FIG. 1 shows a fuel-injection valve that is manufactured in accordance with the present invention.

FIG. 1 shows an electromagnetically actuated fuel-injection valve for use in fuel-injection systems of mixture-compressing internal combustion engines having externally supplied ignition. The valve of FIG. 1 has a stepped internal pole 1, composed of a ferromagnetic material, which is partially surrounded by a solenoid 2. A circumferential, U-shaped coil form 3, which is stepped in the radial direction, accommodates a winding of the solenoid 2 and radially surrounds the internal pole 1 with a slight clearance. At the lower end 4 of the internal pole 1, a flange-like thickening is formed, which extends concentrically, as does the entire internal pole 1, about a longitudinal valve axis 5.

Figure 2:
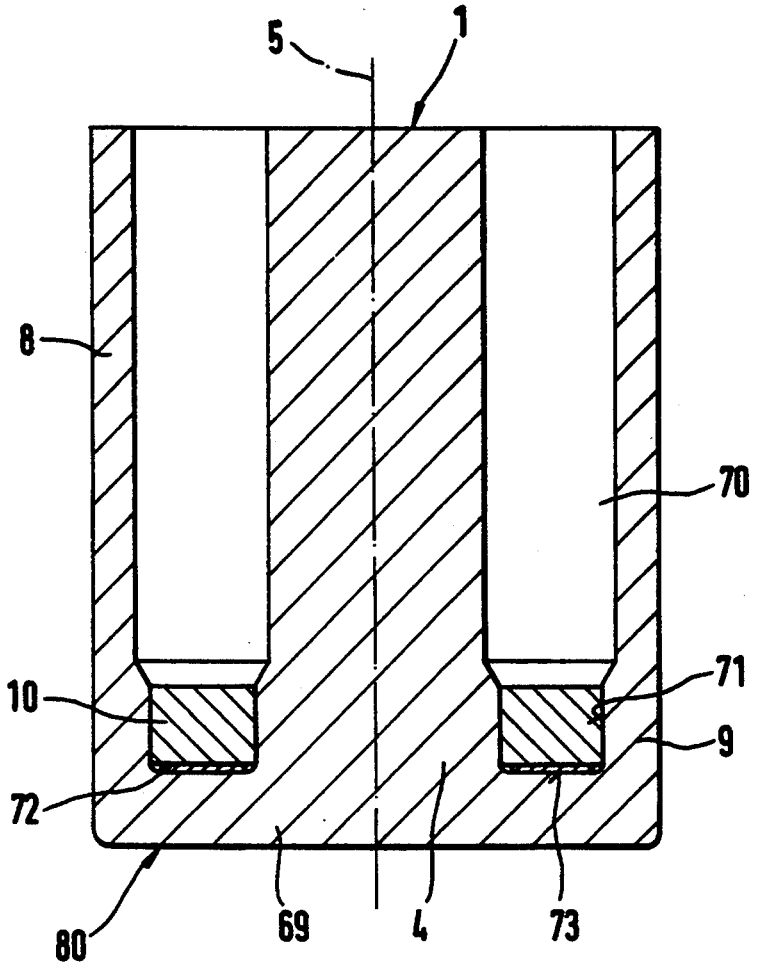
FIG. 2 shows a one-piece magnet body having an inserted intermediate ring.

The solenoid 2 and the stepped coil form 3 are surrounded by a valve sleeve 8. As shown in FIG. 2, before assembly of the fuel-injection valve, the valve sleeve 8 is part of a one-piece, for example, extruded magnetic body 80 which also comprises the internal pole 1. The valve sleeve 8 is first separated from the internal pole 1 in accordance with the method of the present invention.

Referring again to FIG. 1, the valve sleeve 8 extends in the axial direction to the same extent as the internal pole 1 and, at its lower sleeve end 9, has an inwardly directed thickening. Situated between the pole end 4 and the sleeve end 9 is an inserted, non-magnetic intermediate ring 10, which has been soldered to the originally one-piece magnet body 80 consisting of the internal pole 1 and the valve sleeve 8. The intermediate ring 10 prevents a magnetic short-circuit between the internal pole 1 and the valve sleeve 8.

At the upper end of the internal pole 1, a circular housing cover 13 is mounted in the radial direction above the solenoid 2, over the internal pole 1, and extends radially to the valve sleeve 8. On its outer periphery, the housing cover 13 has, for instance, three to six fixing straps 14. The fixing straps 14 are designed so as to allow the housing cover 13 to be permanently affixed on the outside, for instance by welding or soldering, to the valve sleeve 8, resulting in a more secure, upper sealing of the fuel-injection valve. Moreover, it is conceivable to permanently attach the housing cover 13 to the valve sleeve 8 through inexpensive flanging. The housing cover 13 is made, for example, of ferritic sheet metal and has at least one bushing 16, through which contact tags 17 run. The contact tags 17 exit the valve assembly at an electrical attachment plug 18 and provide electrical contact to the solenoid 2.

A radially stepped valve-seat support 20 extends with an upper, radially outwardly directed support section 21 in the axial direction up to the sleeve end 9 of the valve sleeve 8 and abuts the sleeve end 9 with a flat, upper end face 22. The sleeve end 9 of the valve sleeve 8 and the support section 21 of the valve-seat support 20 are securely joined, for example, by means of a radial weld. In a feed-through opening 24 formed concentrically to the longitudinal valve axis 5 and below the solenoid assembly, the valve-seat support 20 has a valve-seat member 25 comprising an apertured spray disk 26. A tubular armature 27, having an upper end abutting the pole end 4 of the internal pole 1, projects into the feed-through opening 24 of the valve-seat support 20. Also arranged in the feed-through opening 24 and protruding downward from the armature 27 is a very short needle valve 28 that is, for instance, tubular and formed in one piece with the armature 27. At a downstream end 29 facing the apertured spray disk 26, the valve needle 28 is joined, for instance by welding, to a spherical valve-closure member 30. The spherical valve-closure member 30 has a generally spherical outer surface with, for instance, five flat regions 31 thereon. The flat regions 31 promote the unhindered flow of fuel through the valve-seat member 25 up to the spray-discharge openings 32. The compact, very light, and movable valve part comprising the tubular armature 27, the valve needle 28 and the valve-closure member 30, makes for a short and compact fuel-injection valve having good dynamic performance and good endurance characteristics.

The fuel-injection valve of FIG. 1 is actuated electromagnetically in a generally known way. The electromagnetic circuit comprising the solenoid 2, the internal pole 1, and the armature 27, operates to move the valve needle 28 axially and, consequently, to open the injection valve against the elastic force of a return spring 33, or rather to close it. A guide opening 34 in the valve-seat member 25 guides the valve-closure member 30 during movement of the valve needle 28 and the armature 27 axially along the longitudinal valve axis 5. The spherical valve-closure member 30 is in contact with a valve-seat surface 35 of the valve-seat support 25. The valve-seat surface 35 is tapered in the shape of a truncated cone in the direction of flow and is formed in the axial direction downstream from the guide opening 34. The outer diameter of the valve-seat member 25 is slightly smaller than the feed-through opening 24 of the valve-seat support 20. At its side facing away from the valve-closure member 30, the valve-seat member 25 is concentrically and securely joined, for instance by welding, to an apertured, cup-shaped spray disk 26.

The apertured spray disk 26 has a circumferential retention rim 40 extending axially downward, and a base part 38, to which the valve-seat member 25 is secured and through which at least one, or for example four, spray-discharge openings 32 are formed by erosion or punching. The retention rim 40 of the apertured spray disk 26 abuts, under radial tensioning, against the wall of the feed-through opening 24 and is joined to the valve-seat support 20, for example, by means of a circumferential and impervious weld 42, produced, for instance, by a laser.

To mechanically guide the movable valve part comprising the armature 27, the valve needle 28 and the valve-closure member 30, in the feed-through opening 24 of the valve-seat support 20, six tappets 45, for example, are formed at an inner, upper end 43 of the valve-seat support 20 in the axial region of the upper support section 21. The tappets 45 are equally spaced on the circumference of the feed-through opening 24 and run inwardly in the direction of the longitudinal valve axis 5. The armature 27 projects through the feed-through opening 24, which is reduced in diameter by the tappets 45, with very little play. The tubular armature 27 has an internal stepped through-hole 47 with a spring stop 48. The return spring 33 is retained between the spring stop 48, at one end, and the pole end 4 of the internal pole 1, at the other end.

A shallow circumferential cavity 49, having a small axial length, is formed between the inner end 43 of the valve-seat support 20 and the non-magnetic intermediate ring 10. The cavity 49 ensures that the magnetic lines of force run from the valve sleeve 8, across the valve-seat support 20 and the armature 27, to the internal pole 1, and do not form any short-circuit from the valve sleeve 8, across the valve-seat support 20, to the internal pole 1, without having an effect on the armature 27. On the side facing the internal pole 1, the cavity 49 is delimited by the circumferential intermediate ring 10, which is made of a non-magnetic material having a high specific electrical resistance, for example an austenitic steel. The influence of the intermediate ring 10 on the magnetic field of the fuel-injection valve is thus kept at a very insignificant level and additional eddy losses are prevented. The intermediate ring 10 is hermetically joined to the internal pole 1 and the valve sleeve 8 by means of soldering between the pole end 4 and the sleeve end 9. The solenoid 2 is thus prevented from coming into contact with the fuel.

While conforming to the contour of the valve-seat support 20, a stepped carrier ring 52 is arranged on the periphery of the valve-seat support 20 and extends axially upwards beyond the upper end of the valve-seat support 20. At its upper end, the carrier ring 52 has several detents 53 on its periphery, for simply and inexpensively securing the carrier ring 52 to the valve-seat support 20. Where not detented, the carrier ring 52 surrounds the sleeve end 9 of the valve sleeve 8 with a constant radial clearance. A fuel filter 55, through which fuel can flow from a fuel source to transverse openings 56, is mounted in the carrier ring 52. The transverse openings 56 penetrate the inner wall of the valve-seat support 20 in the axial region within which the valve needle 28 moves axially inside the valve-seat support 20. Fuel is thus able to flow through the transverse openings 56 into the feed-through opening 24 down to the valve-seat surface 35. The fuel filter 55 is selected in accordance with fuel conditions, in order to avoid susceptibility to temperature or undesired swelling effects.

At least one part of the valve sleeve 8 and the complete housing cover 13 are surrounded by a plastic extrusion coat 58. Also premolded at the same time on this extrusion coat 58 is the electrical power plug 18, through which pass electrical contacts coupled to the solenoid 2. When the fuel-injection valve is partially extrusion-coated, in addition to the outer plastic extrusion coat 58, a clearance space 59, delimited by the solenoid 2, the coil form 3, the valve sleeve 8, and the housing cover 13, is also filled with plastic. The solenoid 2 is thus completely surrounded, on the inside, from above and below by the coil form 3 and, from the outside, by the plastic in the clearance space 59, sealing-off the solenoid 2 and allowing it to stay dry.

Above and below the radial transverse openings 56 in the valve-seat support 20, sealing rings 60 and 61 are arranged on the periphery of the fuel-injection valve. The upper sealing ring 60 surrounds the valve sleeve 8 and is situated in an annular groove 64 formed between a bottom end 62 of the plastic extrusion coat 58 and a top end 63 of the carrier ring 52. The lower sealing ring 61 surrounds the valve-seat support 20 and is retained in an annular groove 66 that is delimited by a bottom end 67 of the carrier ring 52 and by an outer rim 68 having, for example, an L-shaped cross section. The sealing rings 60 and 61 serve to create a seal between the periphery of the fuel-injection valve and a valve seat (not shown), for example in the intake line of the internal combustion engine.

Figure 3:
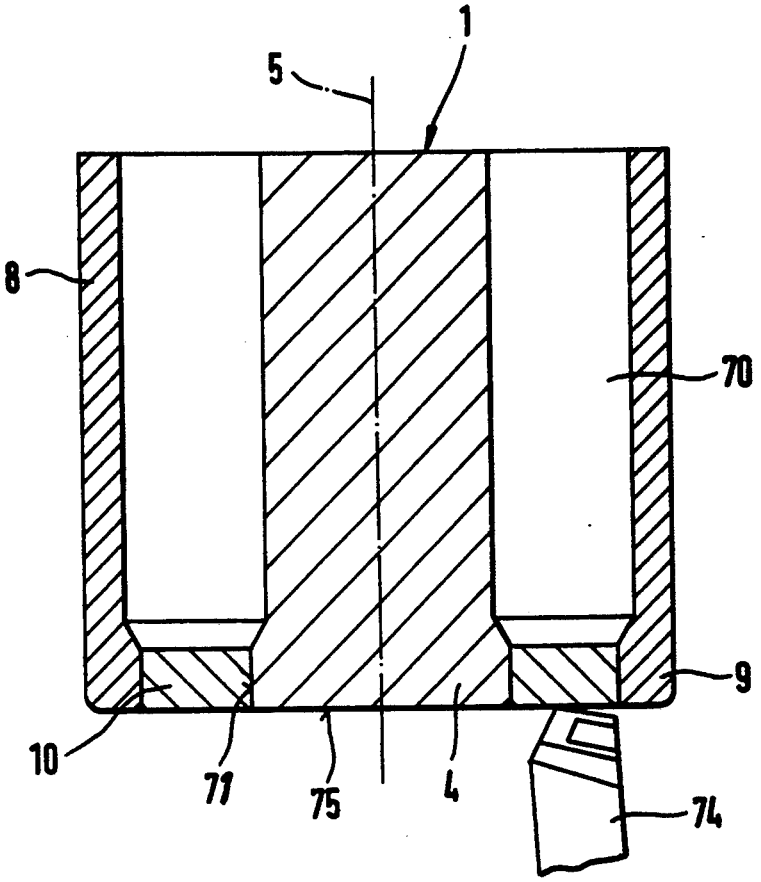
FIG. 3 shows a magnet body after the base is ground off.
Figure 4:
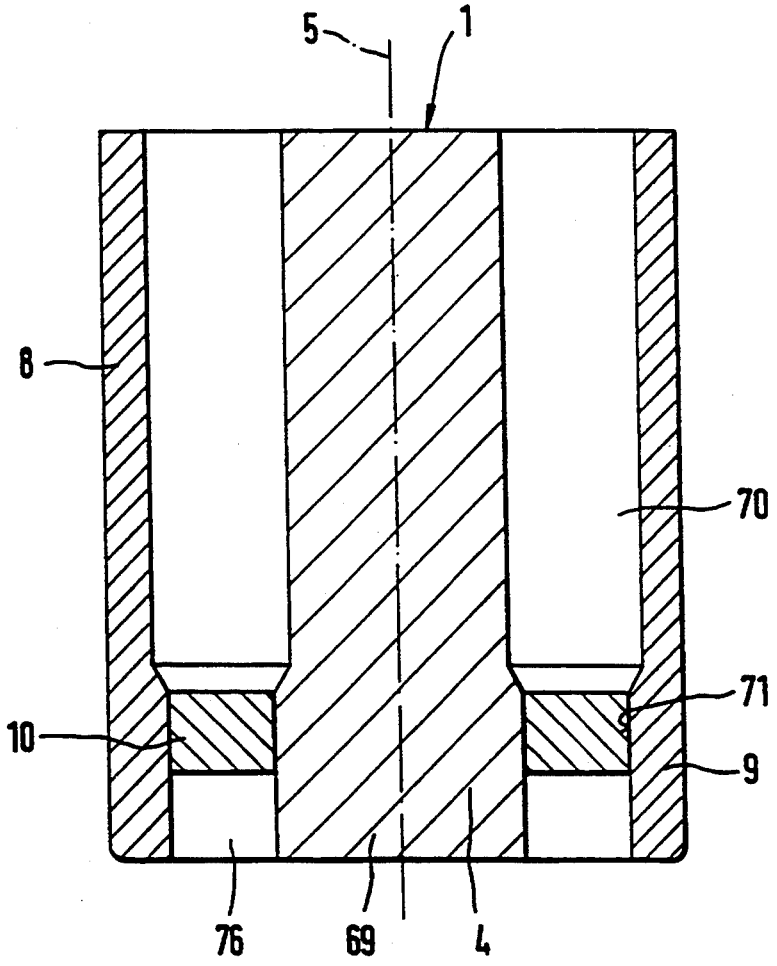
FIG. 4 shows a magnet body having an annular groove for spatially separating the internal pole and the valve sleeve.

FIG. 2 shows the one-piece magnet body 80, which, in accordance with the process of the present invention, is divided into the internal pole 1 and the valve sleeve 8, as shown in FIGS. 3 and 4. Use of the one-piece magnet body 80 is particularly cost-effective. In a first step of the process, the magnet body 80 is extruded from a steel, so that an outer ring pole, which later becomes the valve sleeve 8, and an inner pole section, which later becomes the inner pole 1, are formed. The outer ring pole and the inner pole section are separated over part of the length of the magnet body 80, by a stepped ring opening 70 which is formed axially, concentric to the longitudinal valve axis 5. The outer ring pole and the inner pole section are joined together by a base 69 which is formed by that part of the magnetic body 80 over which the stepped ring opening 70 does not extend.

The ring opening 70 exhibits a substantially constant radial width, which is first reduced at a blind-end-bore-like end 71 of the ring opening 70. The end 71 of the ring opening 70 is radially surrounded on the outside by that part of the magnetic body 80 which later becomes the sleeve end 9 and, on the inside, by that part of the magnetic body which later becomes the pole end 4. The inner and outer diameters of the blind-end-bore-like end 71 of the ring opening 70 determine the widths of the pole end 4 and the sleeve end 9.

In a second step of the process in accordance with the present invention, an annular solder member 72, having, for example, a disk shape, is inserted through the ring opening 70 and placed on an opening base 73 sealing the blind-end-bore-like end 71 of the ring opening 70. During the subsequent soldering operation, the solder member 72 is used to wet the surface of the magnet body 80 to be joined and the non-magnetic intermediate ring 10. In a third process step, the annular intermediate ring 10, which is made of a non-magnetic material having a high specific electrical resistance, is placed on the solder member 72 which is situated on the opening base 73 in the end 71 of the ring opening 70. The ring 10 is, for example, pressed on by a tool, caulked, or left to lie loosely without the application of a tool. FIG. 2 shows the magnet body 80 after completion of the third process step.

In a fourth process step, the intermediate ring 10 is soldered to the magnet body 80 in the area of the end 71 of the ring opening 70, using the solder member 72, which, for example, is a hard solder. The intermediate ring 10 is hard-soldered to the magnet body 80, for example, in a high-frequency furnace, which provides a short duration, local heating in the area of the pole end 4, the sleeve end 9 and the intermediate ring 10. Soldering can also be accomplished using a continuous-heating furnace. The magnet body 80 to be soldered travels through a continuous-heating furnace for two to three hours while being continually heated.

In a fifth and last process step, as depicted in FIG. 3, the extruded base 69 of the magnet body 80 (as shown in FIG. 2), i.e., the material below the intermediate ring 10, is removed, for example, by being ground off with a tool 74. In addition to removing the base 69 of the magnet body 80, a small amount of material is also removed from the intermediate ring 10, for example 0.2 mm axially from the lower surface of the intermediate ring 10. It is thus guaranteed that a very accurate plane surface 75 is formed at the pole end 4 of the internal pole 1, at the sleeve end 9 of the valve sleeve 8, and at the intermediate ring 10. Moreover, by completely grinding off the base 69 and some of the intermediate ring 10, any possibility of a magnetic short-circuit between the internal pole 1 and the valve sleeve 8 is thus eliminated. FIG. 3 shows the parts of the magnet body 80 remaining after the base 69 is removed and after the shaping of the surfaces and outer edges. The outer edge of the surface 75 has been provided with a radius, as may be required. As shown in FIG. 3, the valve sleeve 8 is separate from the internal pole 1.

The separation of the internal pole 1 and the valve sleeve 8 can be achieved without entirely grinding off the base 69. As depicted in FIG. 4, it is possible, for example, to introduce an annular groove 76 which runs axially through the base 69, concentrically with the ring 10, and has a radial width approximately the same as, larger than, or smaller than that of the intermediate ring 10. In this case, as well, a magnetic short-circuit between the internal pole 1 and the valve sleeve 8 is thereby avoided.

What is claimed is:

1. A process for manufacturing a magnetic circuit for a fuel-injection valve, the process comprising the steps of:

forming, from one piece of material, a magnet body comprising an internal pole, a valve sleeve, and a base connecting the internal pole and the valve sleeve, the magnet body thus formed having a ring opening extending through the magnet body in an axial direction above the base, concentric to a longitudinal axis of the fuel-injection valve;

inserting an annular solder member through the ring opening and placing the annular solder member on an opening base of the ring opening;

placing a non-magnetic, annular intermediate ring on the annular solder member;

soldering the intermediate ring to the magnet body; and removing the base, thereby separating the internal pole and the valve sleeve.

2. The process according to claim 1, wherein the intermediate ring is composed of austenitic steel.

3. The process according to claim 1, wherein the intermediate ring is caulked while resting on the solder member.

4. The process according to claim 1, wherein the solder member comprises a hard solder.

5. The process according to claim 1, wherein the soldering step takes place in a high-frequency furnace providing a short-duration, local heating in the area of the intermediate ring.

6. The process according to claim 1, wherein the soldering step takes place in a furnace with continuous heating.

7. The process according to claim 1, further comprising the step of removing material from the intermediate ring in an axial direction so that a plane surface is formed which includes a bottom surface of the intermediate ring, a bottom surface of the internal pole, and a bottom surface of the valve sleeve.

8. The process according to claim 1, wherein the removing step includes grinding at the base.

9. The process according to claim 1, wherein the removing step includes introducing an annular groove through the base.

* * * * *